United States Patent [19]

Habiger

[11] 4,097,196

[45] Jun. 27, 1978

[54] PILOT OPERATED PRESSURE COMPENSATED PUMP CONTROL

[75] Inventor: Cyril W. Habiger, Joliet, Ill.

[73] Assignee: Caterpillar Tractor Co., Peoria, Ill.

[21] Appl. No.: 692,178

[22] Filed: Jun. 1, 1976

[51] Int. Cl.[2] ..... F04B 1/30

[52] U.S. Cl. ..... 417/222

[58] Field of Search ..... 60/444, 445; 91/505, 91/506; 417/212, 218, 221, 222

[56] References Cited

U.S. PATENT DOCUMENTS

| | | | |
|---|---|---|---|
| 3,199,286 | 8/1965 | Anderson | 60/444 |
| 3,214,911 | 11/1965 | Kempson | 60/431 |
| 3,257,959 | 6/1966 | Budzich | 417/217 |
| 3,354,978 | 11/1967 | Budzich | 417/222 |
| 3,384,027 | 5/1968 | Jennings et al. | 417/218 |
| 3,808,952 | 5/1974 | Knaak | 91/505 |
| 3,834,836 | 9/1974 | Hein | 417/222 |
| 3,898,807 | 8/1975 | Habiger | 60/445 |
| 3,918,259 | 11/1975 | Habiger | 417/212 |
| 3,932,993 | 1/1976 | Reidhammer | 60/449 |
| 3,964,262 | 6/1976 | Patton | 60/447 |

FOREIGN PATENT DOCUMENTS

| | | | |
|---|---|---|---|
| 1,212,674 | 11/1970 | United Kingdom | 417/222 |

*Primary Examiner*—William L. Freeh

*Attorney, Agent, or Firm*—Phillips, Moore, Weissenberger, Lempio & Majestic

[57] ABSTRACT

The invention is concerned with an improvement in a pump having a pump body, a swash plate the rotational position of which controls the displacement of the pump and means mounting the swash plate for rotation about an axis generally centrally thereadjacent. The improvement serves to control the pump output. In a broad sense, the improvement comprises means internal of said pump body and acting between said pump body and said swash plate for biasing the swash plate towards a zero displacement position corresponding to a minimum displacement of the pump, and means responsive to discharge pressure of the pump reaching a first magnitude for overriding the biasing means and rotating the swash plate towards a full displacement position corresponding to a maximum displacement of the pump said overriding means comprising servo valve means within said pump body and pilot pump means acting to initially shift said servo valve means to allow discharge pressure to be applied in opposition to said biasing means.

6 Claims, 2 Drawing Figures

12
14
16
18
10
40
38
II
20
II
42
44
28
36
26
34
22
24

PILOT OPERATED PRESSURE COMPENSATED PUMP CONTROL

BACKGROUND OF THE INVENTION

1. Field of the Invention

The invention is particularly concerned with swash plate controlled pumps and is more specifically concerned with means for controlling the displacement of such pumps.

2. Prior Art

The use of pressure compensated or control devices with swash plate controlled variable displacement pumps is known to the art. Generally, such pumps have had control devices which stroke the pump from maximum displacement to minimum displacement. For example, U.S. Pat. No. 3,797,245 illustrates a means to achieve pressure compensation by using an external signal in conjunction with an internal reduced pressure. The pressure compensation means of this invention strokes the pump from maximum displacement to minimum displacement. U.S. Pat. No. 3,808,952 uses a second pump to supply signal pressure at a predetermined maximum rate. U.S. Pat. No. 3,809,501 achieves low flow and low pressures from a pump when there is no load on it. In this patent, however, the pressure compensation means is not an integral part of the pump. Also, the pump taught in this patent starts stroking at a maximum displacement but strokes to a minimum displacement soon after start-up. Also, this patent is not concerned with a pump which uses signal pressure from another source as opposed to pump discharge pressure on start-up. U.S. Pat. Nos. 3,898,807 and 3,803,844 are each concerned with control systems in hydraulic transmission apparatus, which control systems include a variable displacement pump therein.

It would be highly advantageous to provide a pump control that controls the output of the pump from minimum displacement to maximum displacement by using discharge pressure to cause the pump to stroke. It would further be advantageous if such a system could be provided wherein the discharge pressure is modulated to cause the swash plate to move and thereby to control stroking of the pump. It would be still more advantageous if such a system included means causing the pump to be stroked as the discharge pressure reaches too high a value thereby controlling the discharge pressure to fall within determinable limits. It would also be advantageous if such a control system could be made integral with the pump. The present invention provides in its embodiments pump control means which accomplish one or more of the above set out advantages.

SUMMARY OF THE INVENTION

Briefly, the invention is concerned with an improvement in a pump having a pump body, a swash plate, a rotational position of which controls the displacement of the pump and means mounting the swash plate for rotation about an axis generally centrally thereadjacent. The improvement serves to control the output from the pump. It comprises means internal of said pump body and acting between said pump body and said swash plate for biasing the swash plate toward a zero displacement position corresponding to a minimum displacement of the pump and means responsive to discharge pressure of the pump reaching a first magnitude for overriding the biasing means and rotating the swash plate towards a full displacement position corresponding to a maximum displacement of the pump, said overriding means comprising servo valve means within said pump body and pilot pump means acting to initially shift said servo valve means to allow discharge pressure to be applied in opposition to said biasing means.

BRIEF DESCRIPTION OF THE DRAWINGS

The invention will be better understood by reference to the figures of the drawings wherein like numbers denote like parts throughout and wherein.

DETAILED DESCRIPTION OF THE PREFERRED EMBODIMENT

Figure 1:
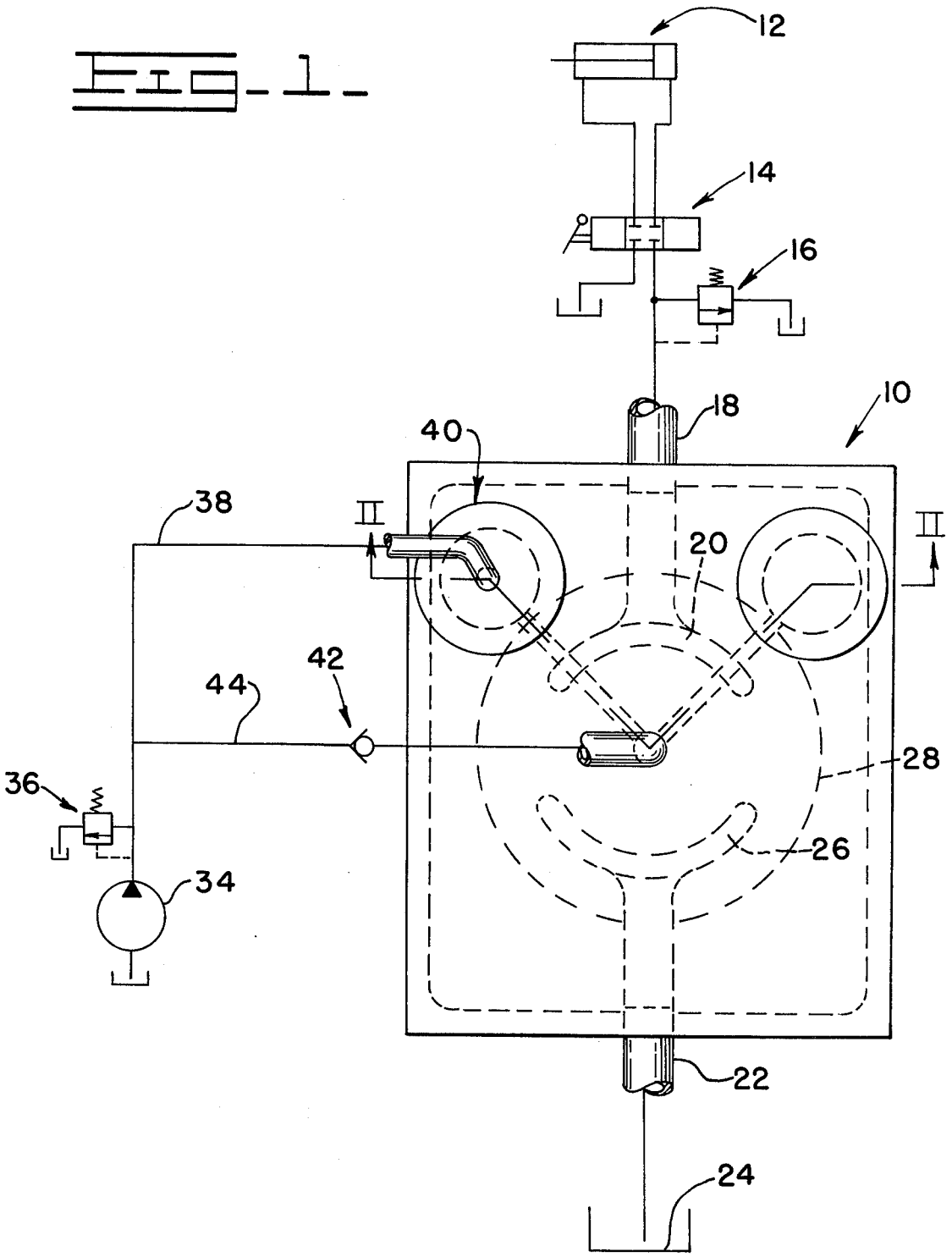
FIG. 1 illustrates in top view, mostly in schematic, an improvement of the present invention as used in a hydraulic system.
Figure 2:
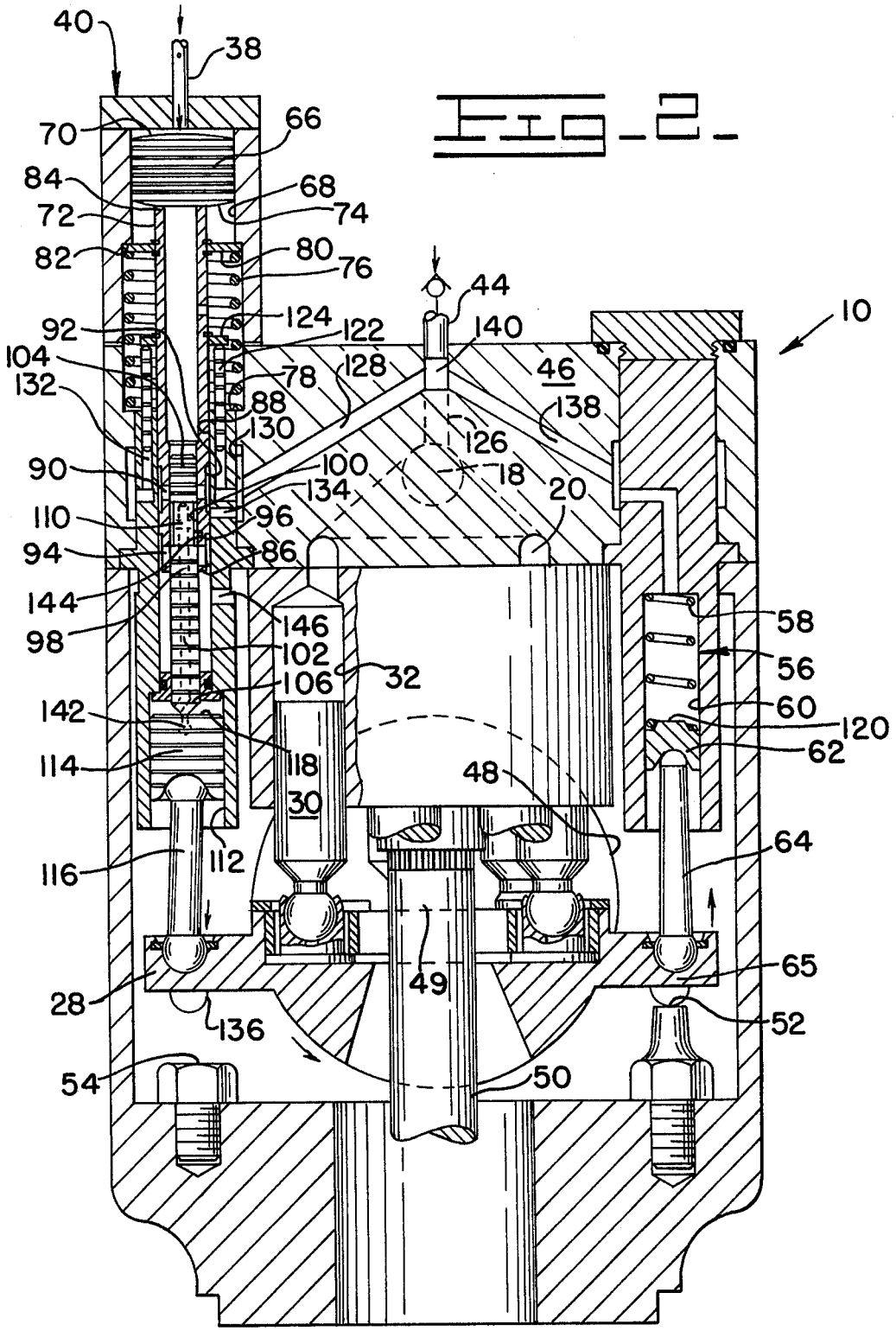
FIG. 2 illustrates a view taken along the line II—II of FIG. 1 and shows in detail the control means of the present invention.

Turning first to FIG. 1, there is illustrated therein a swash plate controlled variable displacement pump 10. The pump 10 supplies pressure to operate a hydraulic system such as a hydraulic cylinder 12, with the flow to and from the hydraulic cylinder being controlled by a typical displacement valve 14. A pressure relief valve 16 is generally provided between the pump 10 and the displacement valve 14 to provide pressure relief when the pressure in the pump discharge line 18 exceeds a desired value. The pump discharge line 18 conducts pressurized fluid from a pump outlet port 20 within the pump 10. Fluid is introduced into the pump 10 via a pump entry line 22 which delivers the fluid from a sump 24 to a pump inlet port 26. A swash plate 28 controls displacement of the pump 10 in a usual manner by controlling movement of a plurality of pump pistons 30 within a plurality of pump bores 32 (FIG 2). A pilot pump 34, having a pilot line pressure relief valve 36 to control its maximum pressure, supplies pressurized pilot fluid via a conduit 38 to servovalve means 40 which is integral with the pump 10. The pilot pump 34 likewise supplies pressure via a check valve 42 in a conduit 44 during pump starting up. As the discharge pressure within the pump 10 builds up, the check valve 42 is forced to stay closed and then the pilot pump 34 only supplies pressure to the servovalve means 40. In some embodiments of the invention, the conduit 44 and the check valve 42 can be omitted by setting the swash plate 28 to be always at a slight angle whereby the pump 10 will have fluid to pump even at start-up.

Turning now primarily to FIG. 2, the operation of the control means of the present invention will be more easily understood. The pump 10, a sectional view of which is shown in FIG. 2, is formed within a pump body 46. The swash plate 28 is rotatably mounted by a ball 48 for rotation about an axis 49 generally centrally adjacent the swash plate 28, said axis 49 generally corresponding to a diameter of the ball 48 which is parallel to the swash plate 28. In a usual manner, the rotational position of the swash plate 28 controls the displacement of the pump through controlling the amount of travel of the pump pistons 30 as a pump drive shaft 50 rotates. It is clear that in the configuration shown in FIG. 2 the pump pistons 30 will not reciprocate at all within the pump bores 32 and hence the pump is set at zero displacement. That is, with the swash plate 28 in the position shown therein, the pump pistons 30 will not be moved downwardly and upwardly within the pump bores 32 as the shaft 50 rotates and hence the pump displacement will be zero. A stop 52 serves to hold the swash plate 28 against clockwise rotation beyond the zero displacement position. Another stop 54 serves to prevent the swash plate 28 from rotating beyond a selected distance whereby it contacts the second stop 54. This serves to define the maximum displacement of the pump. It is clear that when the swash plate 28 is rotated towards or into contact with the second stop 54, then the respective pump pistons 30 will reciprocate downwardly within the respective bores 32 as they rotate with the shaft 50.

On the right-hand side of FIG. 2, there is illustrated biasing means 56 for biasing the swash plate 28 toward the zero displacement position, i.e. towards contact with the first stop 52 which corresponds to a minimum displacement of the pump 10. The particular biasing means illustrated comprise a spring 58 within a biasing bore 60 along with the pressure of fluid within the biasing bore 60 acting against a control plunger 62. Thus, the force acting downwardly upon the control plunger 62 is determined by the spring force of spring 58, the pressure within the biasing bore 60 and the area of the control plunger 62 exposed to the pressure within the biasing bore 60. This downwardly acting force is applied via a link 64 which is rotatably held at one end thereof against the control plunger 62 and at the other end thereof against a first position 65 of the swash plate 28.

Turning to the left-hand side of FIG. 2, there is illustrated therein the previously-mentioned servovalve means 40. The servovalve means 40 includes a relatively large diameter piston 66 reciprocally fitting within a first servobore 68. Pressure from the pilot pump 34 is directly applied via the conduit 38 to a first side 70 of the large diameter piston 66. The force acting downwardly upon the large diameter piston 66 is thus equal to the pressure of the pilot pump as set by the pilot line pressure relief valve 36 or by other means such as a pilot control valve (not illustrated) during steady-state operation multiplied by the area of the first side 70 of the large diameter piston 66. A servo sleeve 72 extends longitudinally from a second side 74 of the large diameter piston 66 towards the swash plate 28. The servo sleeve 72 is biased away from the swash plate 28 by a spring 76 acting between a shoulder 78 of the pump body 46 and a ring 80 attached to and extending outwardly from the follow-up sleeve 72. A shoulder 82 within the first servobore 68 prevents the ring 80 and with it the servo sleeve 72 from traveling beyond a selected distance away from the swash plate 28. Whenever sufficient pilot pump pressure is introduced via the conduit 38 to move the large diameter piston 66 and the servo sleeve 72 downwardly, the biasing force of the spring 76 is exerted in opposition to this motion. The servo sleeve 72 has a first end 84 thereof which generally proceeds directly from the second side 74 of the large diameter piston 66. Adjacent a second end 86 of the servo sleeve 72, said servo sleeve 72 fits reciprocally within a second sleeve bore 88. The servo sleeve 72 has a charging opening 90 therethrough within the second sleeve bore 88, charging opening 90 communicating with a charging annulus 92 which, in a manner which will later be explained, communicates with the pump discharge line 18. The servo sleeve 72 further has a drain opening 94 therethrough intermediate the charging opening 90 and the second end 86 of the servo sleeve 72. The drain opening 94 communicates with a drain annulus 96 thus providing a drain path through the servo sleeve 72.

A follow-up spool 98 fits reciprocally within an inner bore 100 longitudinally formed within servo sleeve 72. The follow-up spool 98 includes a central passageway 102 therethrough extending from adjacent a first end 104 of said follow-up spool 98 to a second end 106 thereof. The central passageway 102 provides a flow path for communicating fluid under pressure from the pump discharge line 18 and the pump outlet port 20 so that it will act to cause the swash plate 28 to rotate away from minimum displacement and towards a maximum or greater displacement. The follow-up spool 98 further includes a crossbore 110 communicating the central passageway 102 with the lateral surface of the follow-up spool 98 intermediate the first end 104 thereof and the second end 106 thereof. The crossbore 110 serves to receive pressurized fluid from the pump discharge line 18 and communicates it via the central passageway 102 to a third servobore 112 above a swash plate piston 114 which fits reciprocally within said third servobore 112. The swash plate piston 114 communicates via a link 116 with the swash plate 28 with the link 116 being generally universally held at one end thereof by the swash plate piston 114 and at the other end thereof by the swash plate 28. Pressurized fluid in the third servobore 112 above the swash plate piston 114 exerts a force downwardly upon the swash plate piston 114 and thereby upon the swash plate 28 proportional to the pressure within said third servobore 112 and the area of a top 118 of the swash plate piston 114. Generally, the area of the top 118 of the swash plate piston 114 is greater than the area of the top 120 of the control plunger 62 so that even with a reduced pressure in the third servobore 112 above the swash plate piston 114, sufficient force will be generated upon the swash plate 28 to cause it to rotate away from a zero displacement position. The crossbore 110 is surfaced on the follow-up spool 98 so as to cooperate respectively with the charging opening 90 and the drain opening 94 as the servo sleeve 72 moves towards and away from the third servobore 112 to provide for filling and draining of the third servobore 112 above the swash plate piston 114.

Slug means, in the embodiment illustrated a plurality of slugs 122, are positioned to act in opposition to the pressurized fluid force exerted via the conduit 38 upon the large diameter piston 66 with the force acting through the slug means being proportional to the pressures at the pump discharge line 18. In the particular embodiment illustrated, the plurality of slugs 122 act against a second ring 124 which extends outwardly from the servo sleeve 72. The pressure from the pump discharge line 18 is applied to a lower end of the slugs 122 via a first passage 126, a first branch passage 128, a pump body undercut 130 and a plurality of communicating conduits 132.

The undercut 130 also communicates with a cross passage 134 which terminates at the lateral surface of the servo sleeve 72. The pressure in the cross passage 134 communicates via the charging annulus 92 and, when the servo sleeve 72 is shifted downwardly under the impetus of pressure from the pilot pump 34, via the charging opening 90 in servo sleeve 72, thence through the crossbore 110 in the follow-up sppol 98 to the central passageway 102 and thence downwardly to the third servobore 112 above the swash plate piston 114. In this mode of operation, the swash plate piston 114 and the swash plate 28 with it are forced downwardly whereby the swash plate is caused to rotate thus shifting the plate from zero displacement to a positive displacement. The force exerted downwardly upon the swash plate 28 is exerted at a second position 136 thereon on an opposite side of the axis 49 about which the swash plate 28 rotates then is the first position 65 (on which the control plunger 62 acts via the link 64) and must, of course, be of sufficient force to overcome the moment created by the control plunger 62 in an opposite direction. Pressure is supplied to the biasing bore 60 of the control plunger 62 via a second branch passage 138 from the first passage 126 and acts in the manner previously described.

As will be obvious from examination of FIG. 2, it is necessary that pressurized fluid be supplied to both the first branch passage 128 and the second branch passage 138 on start-up of the pump. This can be accomplished by simply setting the swash plate 28 at other than a zero displacement as by, for example, raising the first stop 52 sufficiently so as to provide a small displacement rather than a zero displacement. In general, however, the pilot pump 34 will be used to supply fluid during start-up to the first branch passage 128 and the second branch passage 126 through a second passage 140. This allows the swash plate 28 to be set at zero displacement when the pump 10 is not operating. The check valve 42, as previously mentioned, assures that as soon as a reasonable amount of pressure has built up within the pump 10, no flow will occur through the conduit 44 to the second passage 140. The check valve 42 also assures that no flow can occur under any pressurization conditions in a reverse direction through the line 44 and towards the pilot pump 34.

Turning now briefly to the drain mode of operation, when the pressure in the third servobore 112 is sufficiently high to have caused the follow-up spool 98 to travel downwardly under the impetus of a ball 142, linking it to the swash plate piston 114, then the drain annulus 96 connects with the central passageway 102 in the follow-up spool 98 via the crossbore 110, a follow-up spool annulus 144 and the drain opening 94. Thus, the swash plate piston 114 and hence the swash plate 28 can be shifted to lower displacement for the pump 10.

Pilot Operation

In this operation, the pilot pump 34 will supply pressure to the second passage 140 and thence to both the first branch passage 128 and the second branch passage 138. The pressure in the second branch passage 138 will be applied to the control plunger 62 and will create a force downwardly upon the swash plate 28 at the first position 65 thereon. The pressure from the pilot pump 34 will likewise be applied to the first side 70 of the large diameter piston 66 thus causing the servo sleeve 72 to be propelled downwardly. Meanwhile, pressure applied via the first branch passage 128 will travel to the undercut 130 and thence via the communicating conduit 132 to each of the plurality of slugs 122. At the same time, the pressure in the undercut 130 will be applied via the cross passage 134 and the charging annulus 92 and thence via the charging opening 90 to the crossbore 110 of the follow-up spool 98. It should be noted that flow into the crossbore 110 will be metered depending upon the particular relative alignment of the follow-up spool 98 and the servo sleeve 72. The fluid will then flow from the crossbore 110 to the central passageway 102 in the follow-up spool 98 and thence through the second end 106 thereof and into the third servobore 112 above the swash plate piston 114. This will result in a force being exerted downwardly upon the top 118 of the swash plate piston 114 which will cause the swash plate 28 to rotate away from a zero displacement position and towards greater displacement. As the follow-up spool 98 travels downwardly under the impetus of the swash plate piston 114, connection of the crossbore 110 with the charging opening 90 will be broken and connection will be established between the annulus 144 and the drain opening 94 of the servo sleeve 72 and thence via the drain annulus 96 to drain. The drain passage 146 provides the final path to drain. Force upon the plurality of slugs 122 exerted by the pressure at the undercut 130 will cause these slugs to oppose the downward movement of the servo sleeve 72 and of the large diameter piston 66 thus tending to connect the third servobore 112 with drain in the manner just specified.

What results then is a simple pump control which is responsive to engine speed as measured by the speed of the rotating shaft 50 and is also responsive to system requirements. The balance of pressure from the pilot pump 44 against the discharge pressure at the pump discharge line 18 from the pump 10 results in a correct displacement of the pump 10 which provides the right amount of flow and pressure cooperation for an external system such as, for example, the hydraulic cylinder 12. Further, it is clear that when the pressure from the pilot pump 34 increases as by using a high-pressure pilot pump 34 and/or a different setting on the pilot line pressure relief valve 36, the pump 10 will compensate by a shifting of the swash plate 28 to a greater angle until the discharge pressure at the pump discharge line 18 is able to overcome or equal the force of the pressure, as determined by the pressure compensated plurality of slugs 122, exerted by the pilot pump 34 minus the force of the spring 76.

It is further clear that actuation for shifting of the swash plate 28 is determined by a modified pressure of the pressure at the pump's discharge line 18 which is essentially the discharge pressure of the pump 10 across an orifice which comprises a crossover of the charging opening 90 of the servo sleeve 72 with the crossbore 110 of the follow-up spool 98. This orifice will begin to close off and reach an equilibrium condition dependent upon the particular pressure being exerted by the pilot pump 34 and by the pump 10. When load pressure becomes too high, it can be seen that the plurality of slugs 22 will cause the servo sleeve 72 to shift upwardly which in turn will lead to a bleeding of some of the pressure in the third servobore 112 to tank which will then in turn permit the swash plate 28 to come back to a different and lesser angle. The other portion of the control, namely the spring bias control plunger 62, will aid in forcing the swash plate 28 back to a minimum displacement, generally a zero displacement position.

It should be noted that, as mentioned previously, the pump 10 can operate without any of the pressure from the pilot pump 34 being applied to the second passage 140. In this instance, the stop 52 will be raised slightly whereby the swash plate 28 will be in such a position that a small amount of displacement of the pump 10 will result. In this manner, the pressure in the first branch passage 128 and in the second branch passage 138 will be provided by the pump 10 itself. It is, however, important to the practice of the present invention that pressure from the pilot pump 34 be applied via the conduit 38 or the like to against the first side 70 of the large diameter piston 66.

Alternately, piston 66 could be modified into the form of a mechanical plunger and would not then require a pilot pump.

While the invention has been described in connection with specific embodiments thereof, it will be understood that it is capable of further modification, and this application is intended to cover any variations uses or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. In a pump having a pump body, a swash plate the rotational position of which controls the displacement of said pump and means mounting said swash plate for rotation about an axis generally centrally thereadjacent, an improvement for controlling an output from said pump, comprising:

means internal of said pump body and acting between said pump body and said swash plate for biasing said swash plate toward a zero displacement position corresponding to a minimum displacement of said pump; and means responsive to discharge pressure of said pump reaching a first magnitude for overriding said biasing means and rotating said swash plate towards a full displacement position corresponding to a maximum displacement of said pump, said overriding means comprising servo valve means within said pump body and pilot pump means acting to initially shift said servo valve means to allow discharge pressure to be applied in opposition to said biasing means.

2. An improvement as in claim 1, wherein said overriding means comprise servovalve means and pilot pump means acting to shift said servovalve means to allow discharge pressure to be applied in opposition to said biasing means.

3. An improvement as in claim 1, including servo drain means communicating with said servo valve means and within said pump body for venting said discharge pressure when it reaches a second magnitude equal to a sum of a predetermined value plus a pilot pump means determined value, said second magnitude being greater than said first magnitude, said discharge pressure being thereby controlled to fall within a range between said first and second magnitudes.

4. An improvement as in claim 3, wherein said biasing means comprises a plunger biased towards a first position on said swash plate spaced from said axis by first spring means and said discharge pressure and first link means communicating said plunger with said first position.

5. In a pump having a pump body, a swash plate the rotational position of which controls the rotational position of said pump and means mounting said swash plate for rotation about an axis generally centrally thereadjacent, an improvement for controlling an output from said pump, comprising:

a plunger biased towards a first position on said swash plate spaced from said axis by first spring means and discharge pressure of said pump;

first link means communicating said plunger with said first position, said first spring means acting via said plunger and said first link means to bias said swash plate toward a zero displacement position corresponding to a minimum displacement of said pump;

a first servobore within said pump having a first piston reciprocally sitting therewithin;

pilot pump means acting against a first side of said first piston;

a servo sleeve extending longitudinally from a second side of said first piston generally centrally along said first servobore and into a second servobore, said servo sleeve having a first opening therethrough at a first position thereon intermediate the ends thereof and a second opening therethrough further spaced from said first piston than said first opening;

second spring means biasing said first piston away from said swash plate;

a follow-up spool reciprocally sitting within an internal bore of said servo sleeve, a first end of said follow-up spool extending towards said first piston and a second end thereof extending towards a second position on said swash plate spaced from said axis and on an opposite side therefrom from said first position, said follow-up spool including a central passageway therethrough extending from said second end thereof towards said first end thereof, a crossbore communicating said central passageway with a lateral surface of said servo spool intermediate said first and second ends thereof;

a swash plate piston within a third servobore generally coaxial with said first and second servobores and longitudinally spaced therefrom, a first side of said swash plate piston communicating with said second end of said follow-up spool, a second side of said swash plate piston communicating with a second position on said swash plate spaced from said axis on an opposite side thereof from said first position;

conduit means communicating a discharge opening of said pump with an external lateral surface of said servo sleeve intermediate said first and second opening therethrough; and whereby when discharge pressure of said pump reaches a first magnitude said biasing of said plunger is overridden and said swash plate is rotated towards a full displacement position corresponding to a maximum displacement of said pump servodrain means for venting said discharge pressure when it reaches a second magnitude equal to a sum of a predetermined value plus a pilot pump means determined value, said second magnitude being greater than said first magnitude, said discharge pressure being thereby controlled to fall within a range between said first and second magnitudes.

6. An improvement as in claim 5, including slug means acting in opposition to said pilot pump means to oppose movement of said servo sleeve towards said swash plate, said slug means being operated by discharge pressure.

* * * * *